US010411387B2

(12) United States Patent
Nishida et al.

(10) Patent No.: US 10,411,387 B2
(45) Date of Patent: Sep. 10, 2019

(54) TERMINAL

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Shiro Nishida, Mie (JP); Seido Nishijima, Mie (JP)

(73) Assignees: AutoNetworks Technologies, Ltd. (JP); Sumitomo Wiring Systems, Ltd. (JP); Sumitomo Electric Industries, Ltd. (JP)

( * ) Notice: Subject to any disclaimer, the term of this patent is extended or adjusted under 35 U.S.C. 154(b) by 0 days.

(21) Appl. No.: 15/770,561

(22) PCT Filed: Oct. 7, 2016

(86) PCT No.: PCT/JP2016/079907
§ 371 (c)(1),
(2) Date: Apr. 24, 2018

(87) PCT Pub. No.: WO2017/073290
PCT Pub. Date: May 4, 2017

(65) Prior Publication Data

US 2019/0058274 A1 Feb. 21, 2019

(30) Foreign Application Priority Data

Oct. 28, 2015 (JP) ..... 2015-211718

(51) Int. Cl.
*H01R 13/24* (2006.01)
*H01R 13/50* (2006.01)
(Continued)

(52) U.S. Cl.
CPC ..... *H01R 13/2421* (2013.01); *H01R 13/24* (2013.01); *H01R 13/50* (2013.01);
(Continued)

(58) Field of Classification Search
CPC .... H01R 13/2421; H01R 13/24; H01R 11/18; H01R 24/38; H01R 12/52; H01R 12/714;
(Continued)

(56) References Cited

U.S. PATENT DOCUMENTS 3,771,110 A * 11/1973 Reed ..... B61G 5/10 439/271
4,655,526 A * 4/1987 Shaffer ..... H01R 13/193 439/159

(Continued)

FOREIGN PATENT DOCUMENTS

| | | |
|---|---|---|
| JP | 2002-274290 | 9/2002 |
| JP | 2003-31194 | 1/2003 |
| JP | 2009-070656 | 4/2009 |

OTHER PUBLICATIONS

International Search Report dated Dec. 20, 2016.

*Primary Examiner* — Edwin A. Leon
*Assistant Examiner* — Matthew T Dzierzynski
(74) *Attorney, Agent, or Firm* — Gerald E. Hespos; Michael J. Porco; Matthew T. Hespos

(57) ABSTRACT

A terminal (10) disclosed by this specification includes a case (20), and a coil spring (30) is accommodated in a compressed state inside the case (20). A first conductive member (40) is sandwiched between a first end of the coil spring (30) and an inner wall of the case (20) and has a contact portion (43) movable in a direction to compress the coil spring (30) farther. A shaft center (70) is accommodated inside the coil spring (30) and projects in an axial direction of the coil spring (30).

6 Claims, 11 Drawing Sheets

(51) Int. Cl.
*H01R 13/52* (2006.01)
*H01R 13/405* (2006.01)

(52) U.S. Cl.
CPC ..... *H01R 13/405* (2013.01); *H01R 13/5202* (2013.01); *H01R 13/5219* (2013.01)

(58) Field of Classification Search
CPC ..... H01R 13/05; H01R 13/17; H01R 13/193; H01R 13/2428; H01H 1/24
See application file for complete search history.

(56) References Cited

U.S. PATENT DOCUMENTS 4,904,213 A * 2/1990 Hock ..... G01R 1/067 439/482
5,641,315 A * 6/1997 Swart ..... G01R 1/06722 324/72.5
5,807,123 A * 9/1998 Spiegelaar ..... H01R 13/05 439/136
5,823,832 A * 10/1998 Das ..... A61B 5/0416 439/817
5,879,198 A * 3/1999 Sekimori ..... H01R 13/44 439/289
6,494,748 B1 12/2002 Mori et al.
6,739,914 B2 * 5/2004 Strandfelt ..... H01R 13/2421 439/638
6,773,312 B2 * 8/2004 Bauer ..... H01R 13/2421 439/816
6,932,620 B2 * 8/2005 Ishiguro ..... H01Q 1/1271 439/66
7,134,878 B2 * 11/2006 Zheng ..... H01R 13/2421 439/65
7,494,387 B2 * 2/2009 Ohshima ..... H01R 13/2421 439/841
7,621,785 B2 * 11/2009 Lin ..... H01R 9/18 439/553
9,130,328 B1 * 9/2015 Huang ..... H01R 13/2421

* cited by examiner

TERMINAL

BACKGROUND

Field of the Invention

This specification relates to a terminal.

Description of the Related Art

Japanese Unexamined Patent Publication No. 2002-274290 discloses a power supply device to be electrically connected by butting contacts against each other. This power supply device is composed of a female junction provided on a body side and a male junction provided on a door side. The female junction is provided such that one end of a case in the form of a hollow tube is exposed to the outside from the body. Left and right end plates are provided in the case, and a coil spring is sandwiched and compressed between these end plates. However, recesses are provided on the end plates and end parts of the coil spring are accommodated in these recesses in the above-described power supply device. Thus, the coil spring may be detached from the end part(s) if the female junction and the male junction are connected obliquely or if strong vibration is applied to the female junction from the body.

SUMMARY

A terminal disclosed by this specification includes a case, and a coil spring is accommodated in a compressed state inside the case. A first conductive member is sandwiched between a first end of the coil spring and an inner wall of the case. The first conductive member has a contact portion movable in a direction to further compress the coil spring. A shaft center is accommodated inside the coil spring and projects in an axial direction of the coil spring. According to this configuration, the coil spring is supported by the shaft center when a force is applied to the contact portion and the coil spring is deflected. As a result, the inclination of the coil spring can be suppressed.

The terminal may further include a second conductive member sandwiched between a second end of the coil spring and the inner wall of the case. The shaft center may be crimped to a hole edge part of a fixing hole that penetrates through the second conductive member. According to this configuration, the shaft center is fixed to the second conductive member. Thus, the inclination of the shaft center can be prevented.

The case may include an escaping hole for allowing an end part of the shaft center projecting outward from the fixing hole of the second conductive member to escape. According to this configuration, the end part of the shaft center is fixed to the hole edge part of the fixing hole while penetrating through the second conductive member. Therefore, the shaft center can be fixed firmly to the second conductive member. Further, the interference of the end part of the shaft center with the inner wall of the case can be avoided.

According to the terminal disclosed by this specification, it is possible to suppress the inclination of a coil spring.

DETAILED DESCRIPTION

Figure 1:
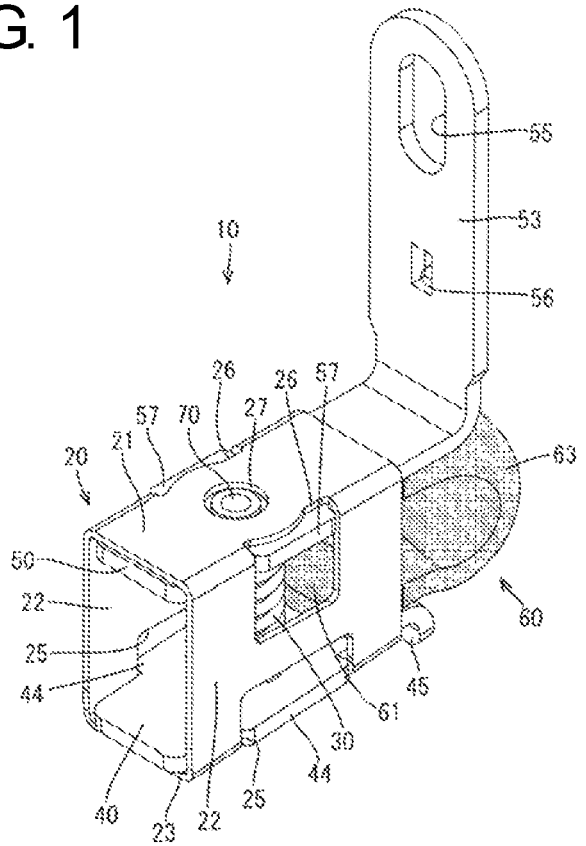
FIG. 1 is a perspective view of a terminal in an embodiment.

An embodiment is described with reference to FIGS. 1 to 11. A terminal 10 of this embodiment includes, as shown in FIG. 1, a case 20, a coil spring 30 accommodated in a compressed state inside the case 20, a first conductive member 40 and a second conductive member 50 disposed on both ends of the coil spring 30 and a wire 60 conductively connecting the conductive members 40, 50. The wire 60 in this embodiment is a braided wire made of metal wires of copper alloy or the like.

Figure 2:
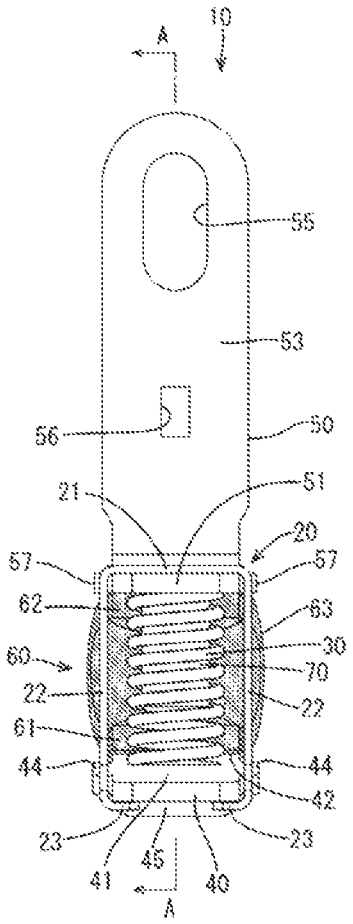
FIG. 2 is a side view of the terminal viewed from a side opposite to a wire.
Figure 3:
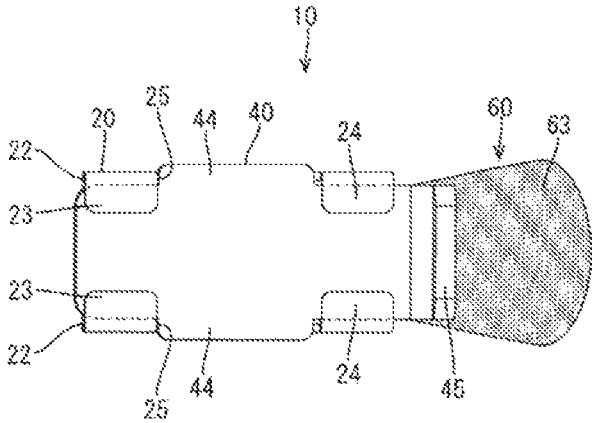
FIG. 3 is a bottom view of the terminal.

The case 20 is formed by press-working a metal plate material such as a SUS material and includes, as shown in FIG. 2, a ceiling wall 21, two side walls 22 extending down from both sides of the ceiling wall 21 and supports 23, 24 extending in from the lower edges of the side walls 22 to face the ceiling wall 21. As shown in FIG. 3, the supports 23, 24 are composed of two first supports 23 disposed on a shown left end of the first conductive member 40 and two second supports 24 disposed on a shown right end of the first conductive member 40.

Figure 4:
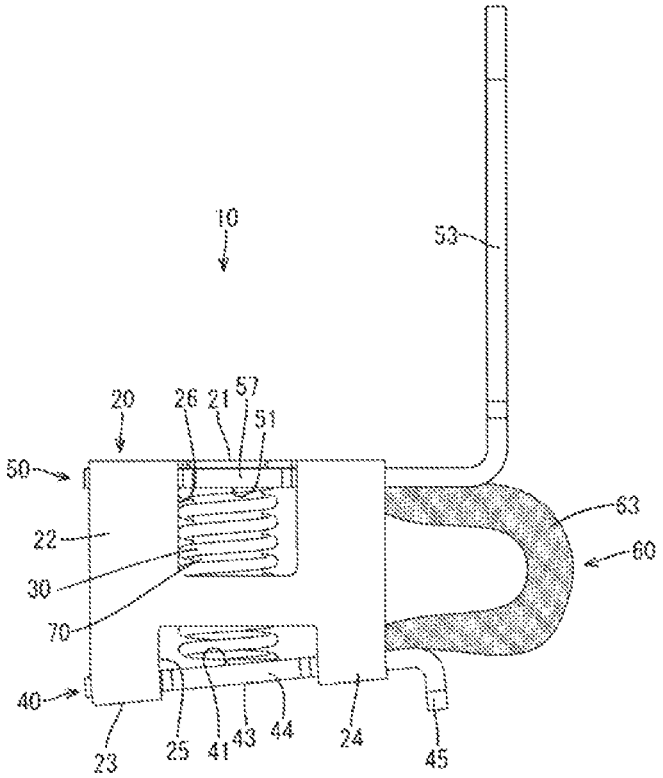
FIG. 4 is a front view of the terminal.
Figure 5:
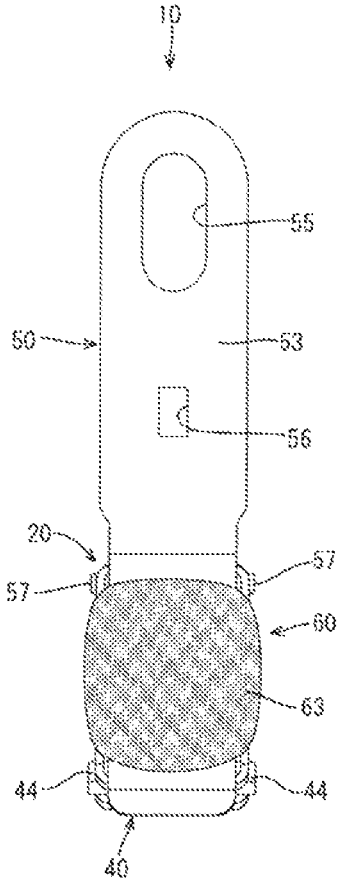
FIG. 5 is a side view of the terminal viewed from the wire side.
Figure 6:
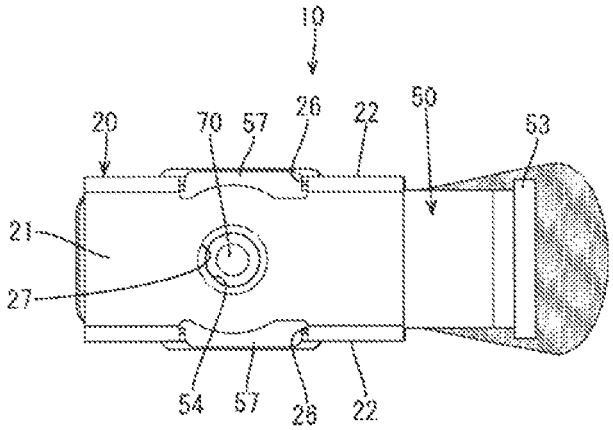
FIG. 6 is a plan view of the terminal.
Figure 7:
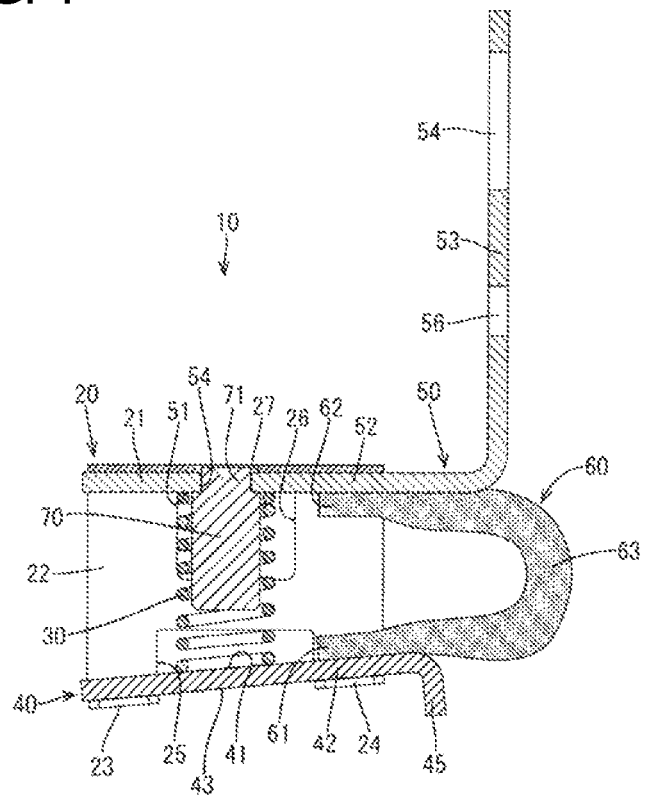
FIG. 7 is a section along A-A in FIG. 2.

As shown in FIG. 4, a first opening 25 is provided between the first and second supports 23 and 24 in each side wall 22. A second opening 26 narrower and vertically longer than the first opening 25 is provided above the first opening 25 in each side wall 22. Further, as shown in FIG. 6, an escaping hole 27 is provided to penetrate through the ceiling wall 21. The escaping hole 27 is located between the second openings 26. Further, as shown in FIG. 7, an interval between the first support 23 and the ceiling wall 21 is larger than an interval between the second support 24 and the ceiling wall 21. The first and second supports 23 and 24 are coplanar.

The coil spring 30 is formed by coiling a metal wire material of SUS or the like and sandwiched in a compressed state by the first and second conductive members 40, 50. Thus, the coil spring 30 biases both the first and second conductive members 40, 50. By this biasing force, the first conductive member 40 is sandwiched between the lower end of the coil spring 30 and inner surfaces of the respective supports 23, 24 and the second conductive member 50 is sandwiched between the upper end of the coil spring 30 and the inner surface of the ceiling wall 21.

The first conductive member 40 is formed by press-working a metal plate material, such as copper alloy, and includes, as shown in FIG. 7, a spring receiving portion 41 for supporting the lower end of the coil spring 30 and a wire connecting portion 42 supported by the second supports 24 of the case 20. The wire 60 in this embodiment is connected to the wire connecting portion 42 by welding or caulking. The spring receiving portion 41 is located between the first and second supports 23 and 24 and is exposed to the outside of the case 20 in the first openings 25 of the case 20. The lower surface of the spring receiving portion 41 serves as a contact portion 43 with a mating terminal 110 to be described later. The contact portion 43 is arranged on an axis of the coil spring 30 and between the first and second supports 23 and 24.

The first conductive member 40 is accommodated mostly inside the case 20, but two protruding pieces 44 provided on both side edges of the spring receiving portion 41 and a bent piece 45 extending down from an end edge on the side of the wire connecting portion 42 are disposed outside the case 20. The two protruding pieces 44 are accommodated respectively in the two first openings 25. The protruding pieces 44 contact opening edge parts of the first openings 25 in the front-rear direction (lateral direction in FIG. 4), thereby allowing an upward movement of the first conductive member 40 while suppressing movements of the first conductive member 40 in the front-rear direction.

On the other hand, the second conductive member 50 is formed by press-working a metal plate material such as copper alloy and includes a spring receiving portion 51 for supporting the upper end of the coil spring 30, a wire connecting portion 52 disposed at a position facing the wire connecting portion 42 of the first conductive member 40 and a device-side connecting portion 53 rising upward while being perpendicular to the wire connecting portion 52. A fixing hole 54 penetrates through the spring receiving portion 51. Further, the device-side connecting portion 53 is provided with a bolt hole 55 and a locking hole 56.

Two protruding pieces 57 are provided on both side edges of the spring receiving portion 51. The protruding pieces 57 are accommodated respectively in the two second openings 26. The protruding pieces 57 come into contact with opening edge parts of the second openings 26 in the front-rear direction (lateral direction in FIG. 4), thereby allowing a downward movement of the second conductive member 50 while suppressing movements of the second conductive member 50 in the front-rear direction.

As shown in FIG. 7, the wire 60 is composed of a first end portion 61 connected to the wire connecting portion 42 of the first conductive member 40, a second end portion 62 connected to the wire connecting portion 52 of the second conductive member 50 and an intermediate part 63 coupling the first and second end portions 61, 62. The intermediate part 63 is disposed outside the case 20 and substantially U-shaped. Since the wire 60 is flexible, the intermediate part 63 is deflected and deformed if the first and second conductive members 40, 50 relatively move.

A shaft center 70 is accommodated inside the coil spring 30. The shaft center 70 projects in an axial direction of the coil spring and an end part 71 of the shaft center 70 is disposed through the fixing hole 54. The shaft center 70 is made of metal such as brass and has a cylindrical shape. The end part 71 of the shaft center 70 is struck from above to be caulked, thereby being crimped to a hole edge part of the fixing hole 54. A part of the end part 71 of the shaft center 70 projecting up from the fixing hole 54 is located above the upper surface of the ceiling wall 21 of the case 20 and accommodated in the escaping hole 27 of the case 20.

The lower end of the shaft center 70 is located above the inner surface of the spring receiving portion 41 of the first conductive member 40. Specifically, the lower end of the shaft center 70 is at as low a position as possible within a range where the lower end of the shaft center 70 and the first conductive member 40 do not interfere with each other if the first conductive member 40 is lifted up by the mating terminal 110. By this arrangement, it is possible to suppress the inclination of the coil spring 30 and the bending of the coil spring 30 at an intermediate position.

Figure 8:
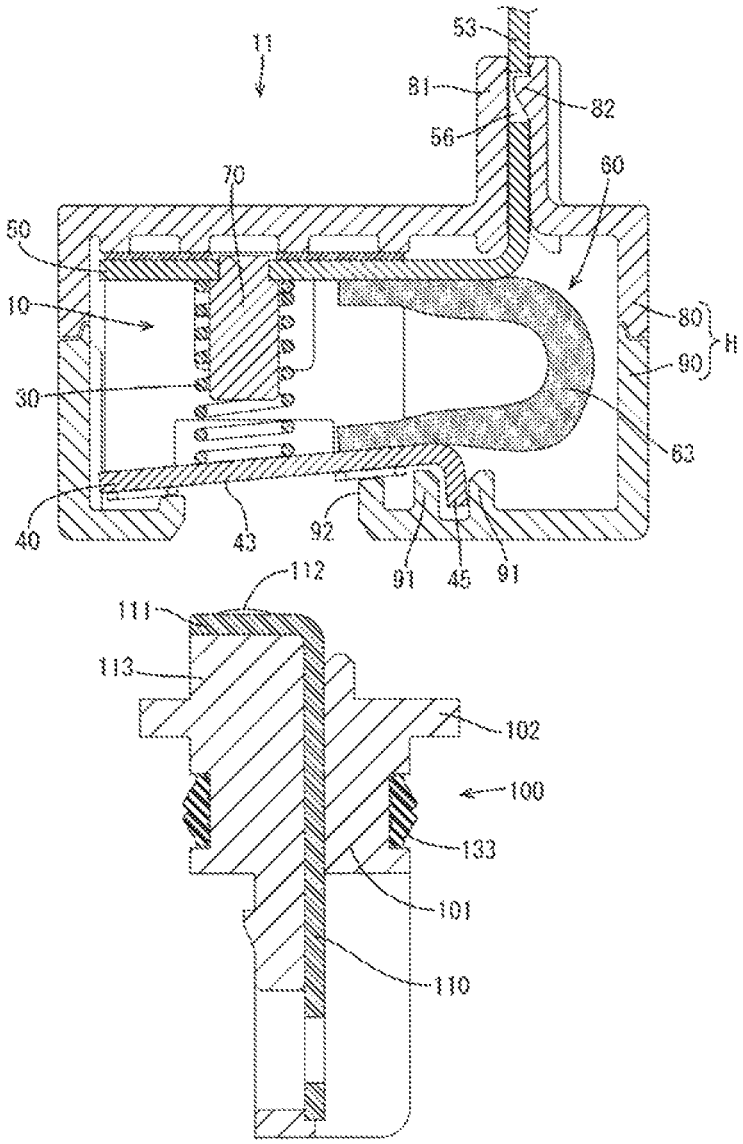
FIG. 8 is a section showing a state before a mating connector is connected to a connector.

As shown in FIG. 8, the terminal 10 is accommodated inside a housing H composed of upper and lower insulating members 80, 90. A connector 11 is constituted by the terminal 10 and the housing H. Two position restricting ribs 91 are provided on a bottom wall of the lower insulating member 90, and the bent piece 45 of the first conductive member 40 is accommodated between the two position restricting ribs 91. In this way, movements of the terminal 10 in the front-rear direction (lateral direction in FIG. 8) inside the housing H are suppressed.

On the other hand, the upper insulating member 80 is provided with a lead-out portion 81 for leading out the device-side connecting portion 53 to the outside of the housing H. A locking lance 82 is provided inside the lead-out portion 81. This locking lance 82 is fit into the locking hole 56 of the device-side connecting portion 53 to be locked, thereby suppressing a movement of the second conductive member 50 inward of the housing H. The intermediate part 63 of the wire 60 is disposed below the lead-out portion 81, and is an area from the first end portion 61 to the second end portion 62 of the wire 60. The intermediate part 63 is disposed outside the case 20, but inside the housing H in a manner to avoid interference with the inner wall of the housing H.

The lower insulating member 90 is provided with a fitting recess 92 having an opening for exposing the contact portion 43 of the first conductive member 40 to the outside. On the other hand, a mating connector 100 to be connected to the connector 11 includes a mating housing 101 made of synthetic resin and the mating terminal 110 insert-molded in the mating housing 101. The mating terminal 110 is L-shaped, and the mating contact portion 111 facing the contact portion 43 is provided on one end of the mating terminal 110. A spherical portion 112 circular in a plan view is formed on the upper surface of the mating contact portion 111 by striking the mating contact portion 111 from the lower surface. The mating contact portion 111 is disposed in a fitting portion 113 and can fit into the fitting recess 92 of the connector 11.

Figure 9:
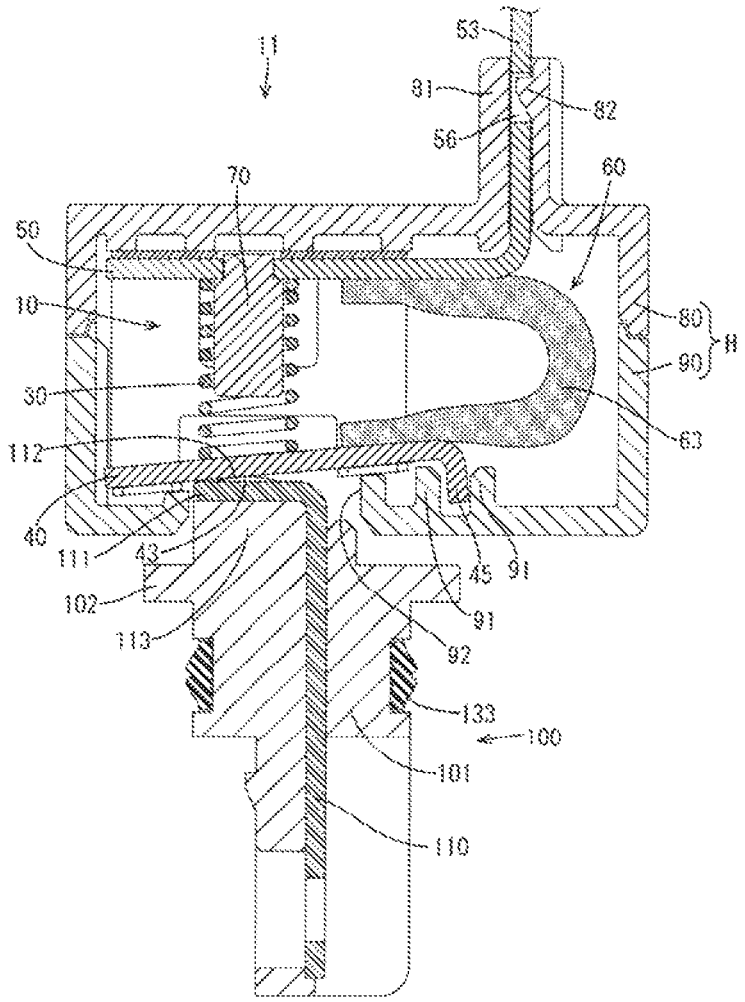
FIG. 9 is a section showing a state where a mating contact portion is butted against a first conductive member from the state of FIG. 8.
Figure 10:
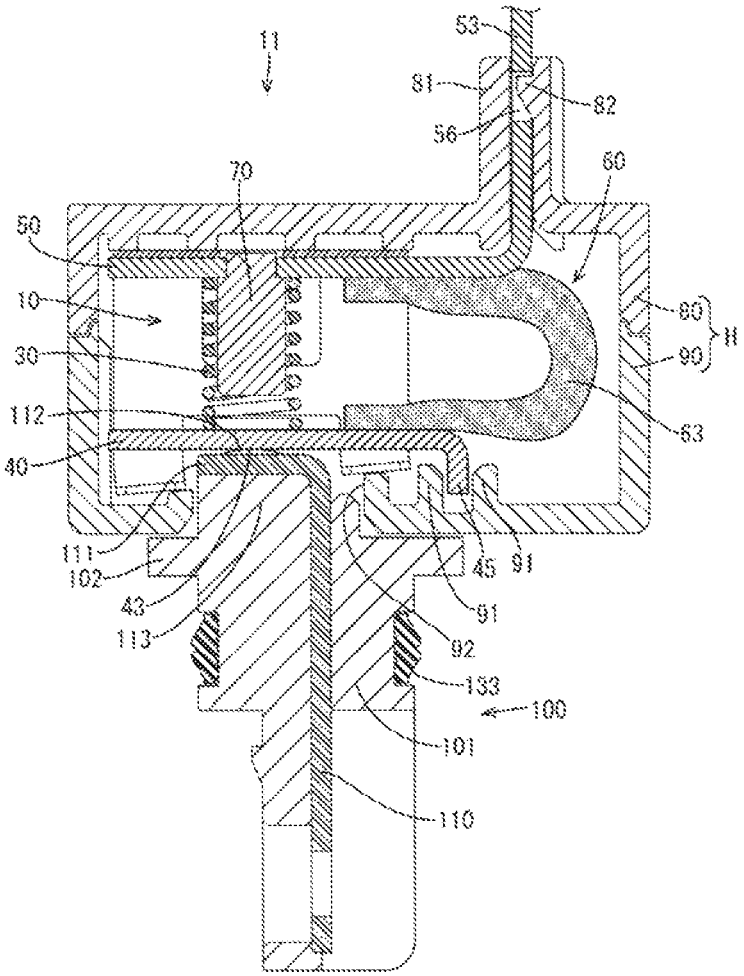
FIG. 10 is a section showing a state where the first conductive member is pushed into a case by butting the mating contact against the first conductive member from the state of FIG. 9.

As the fitting portion 113 is fit into the fitting recess 92, the spherical portion 112 contacts the contact portion 43, as shown in FIG. 9. As the fitting portion 113 is fit farther, the first conductive member 40 is lifted up and the coil spring 30 is compressed, as shown in FIG. 10. Further, the wire 60 is deflected slightly by a movement of the first conductive member 40, but does not contact the inner wall of the housing H. The coil spring 30 is set in the compressed state in advance. Thus, a large spring force is generated only by slightly deflecting the coil spring 30. In this way, a spring force of the coil spring 30 is generated and produces a predetermined contact pressure between the spherical portion 112 of the mating terminal 110 and the contact portion 43 of the terminal 10. Thus, the mating terminal 110, the first conductive member 40, the wire 60 and the second conductive member 50 are connected conductively.

Figure 11:
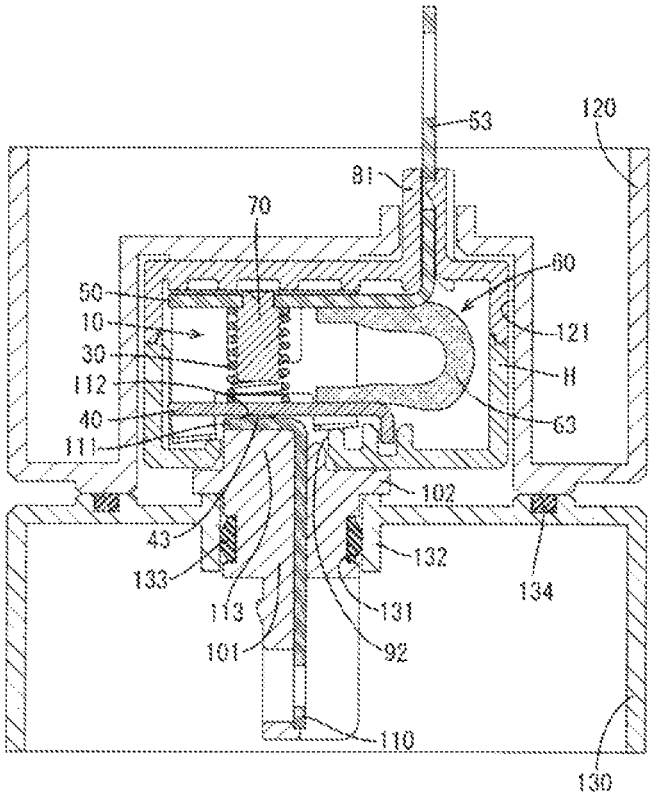
FIG. 11 is a section showing a use example of the terminal of the embodiment.

Next, a use example of the connector 11 of this embodiment is described with reference to FIG. 11. The connector 11 is mounted in a mounting recess 121 provided by recessing the lower surface of an inverter case 120, and only the lead-out portion 81 and the device-side connecting portion 53 of the second conductive member 50 are introduced into the inverter case 120. On the other hand, the mating connector 100 is disposed inside a mounting hole 131 that penetrates through a motor case 130. A peripheral wall 132 is provided around the mounting hole 131 and a flange 102 of the mating housing 101 is supported on the peripheral wall 132.

Further, a rubber ring 133 is sandwiched between the mating housing 101 and the peripheral wall 132. Furthermore, a packing 134 arranged to circle the mating connector 100 is sandwiched between the upper surface of the motor case 130 and the inverter case 120. In this way, a water-stop region is ensured inside both cases 120, 130 and both connectors 11, 100 are connected conductively in this water-stop region. Accordingly, the mating terminal 110 and the first conductive member 40 need not be bolted, and the electrical connection of the connectors 11, 100 is completed merely by mounting the inverter case 120 on the motor case 130. Thus, a connecting operation is simplified and work efficiency is improved.

As described above, the coil spring 30 is supported by the shaft center 70 when a force is applied to the contact portion 43 and the coil spring 30 is deflected, thereby suppressing inclination of the coil spring 30.

The second conductive member 50 may be sandwiched between the other end of the coil spring 30 and the inner wall of the case 20, and the shaft center 70 may be crimped to the hole edge part of the fixing hole 54 that penetrates through the second conductive member 50. According to this configuration, the fixing of the shaft center 70 to the second conductive member 50 prevents inclination of the shaft center 70.

The case 20 may include the escaping hole 27 so that the end part of the shaft center 70 can projecting out from the fixing hole 54 of the second conductive member 50 to escape. According to this configuration, the end part of the shaft center 70 is fixed to the hole edge part of the fixing hole 54 while penetrating through the second conductive member 50. Thus, the shaft center 70 can be fixed firmly to the second conductive member 50. Further, the interference of the end part of the shaft center 70 with the inner wall of the case 20 can be avoided.

The invention is not limited to the above described and illustrated embodiment. For example, the following various modes also are included.

Although the shaft center 70 is fixed to the second conductive member 50 in the above embodiment, the shaft center 70 may be fixed to the first conductive member 40 or may be fixed to the case 20.

Although the shaft center 70 is crimped to the hole edge part of the fixing hole 54 in the above embodiment, the end part of the shaft center 70 may be fixed to the second conductive member 50 by resistance welding, brazing or the like.

Although the case 20 is provided with the escaping hole 27 in the above embodiment, an escaping hole may be provided in the second conductive member 50 and the end part of the shaft center 70 may be fixed to the case 20.

Although the spherical portion 112 having a circular shape in a plan view is illustrated in the above embodiment, a spheroidal portion having an oval or elliptical shape in a plan view may be provided.

LIST OF REFERENCE SIGNS

10 . . . terminal
20 . . . case
21 . . . ceiling wall (inner wall)
23 . . . first support (inner wall)
24 . . . second support (inner wall)
27 . . . escaping hole
30 . . . coil spring
40 . . . first conductive member
43 . . . contact portion
50 . . . second conductive member
54 . . . fixing hole
70 . . . shaft center
71 . . . end part

The invention claimed is:

1. A terminal, comprising:

a case;

a coil spring having opposite first and second ends and being accommodated in a compressed state inside the case;

a first conductive member sandwiched between the first end of the coil spring and an inner wall of the case and including a contact portion movable in a direction to compress the coil spring farther;

a second conductive member sandwiched between the second end of the coil spring and the inner wall of the case, a fixing hole penetrating through the second conductive member at a position aligned with an axis of the coil spring; and a shaft center accommodated inside the coil spring and projecting in an axial direction of the coil spring, the shaft center having an end protruding through the fixing hole in the second conductive member and a part of the shaft center disposed in the fixing hole of the second conductive member being caulked into engagement with a part of the second conductive member adjacent the fixing hole, wherein the case includes an escaping hole aligned with the fixing hole in the second conductive member and receiving an end of the shaft center that projects through the fixing hole and beyond the second conductive member.

2. A terminal, comprising:

a case having a ceiling wall, two opposed side walls projecting from opposite sides of the ceiling wall and supports projecting from ends of the side walls remote from the ceiling wall and into positions opposed to the ceiling wall;

a first conductive plate disposed between the side walls of the case and between the ceiling wall and the supports;

a second conductive plate disposed between the side walls and between the ceiling wall and the first conductive plate, a fixing hole penetrating through the second conductive plate;

a coil spring having opposite first and second ends and being accommodated in a compressed state inside the case with the first end of the coil spring biased against the first conductive plate and the second end of the coil spring biased against the second conductive plate at positions outward of the fixing hole; and a shaft accommodated inside the coil spring and projecting in an axial direction of the coil spring, an end of the shaft passing through the fixing hole and caulked into engagement with the second conductive plate adjacent the fixing hole.

3. The terminal of claim 2, wherein the case includes first openings formed in parts of the side walls remote from the ceiling wall and second openings formed in parts of the side walls adjacent the ceiling wall, first protruding pieces protruding from opposite sides of the first conductive plate and into the first openings in the side walls of the case, and second protruding pieces protruding from opposite sides of the second conductive plate and into the second openings in the side walls of the case.

4. The terminal of claim 3, wherein the first and second openings and the first and second protruding pieces are dimensioned to permit movement of the first and second conductive plates toward and away from one another while restricting movement of the first and second conductive plates in directions transverse to the axial direction of the coil spring.

5. The terminal of claim 2, wherein the case includes an escaping hole aligned with the fixing hole in the second conductive plate and receiving an end of the shaft center that projects through the fixing hole and beyond the second conductive plate.

6. The terminal of claim 2, wherein the second conductive plate has an end external of the case and having a bolt hole formed therethrough.

* * * * *